US009427840B2

(12) United States Patent
Cloutier

(10) Patent No.: US 9,427,840 B2
(45) Date of Patent: Aug. 30, 2016

(54) HONING TOOL HOLDER WITH A FEED SYSTEM POWERED BY THROUGH-THE-SPINDLE COOLANT PRESSURE AND ACTUATED BY SPINDLE ROTATION

(75) Inventor: Daniel R. Cloutier, Clive, IA (US)

(73) Assignee: Sunnen Products Company, St. Louis, MO (US)

( * ) Notice: Subject to any disclaimer, the term of this patent is extended or adjusted under 35 U.S.C. 154(b) by 679 days.

(21) Appl. No.: 13/825,399

(22) PCT Filed: Sep. 21, 2011

(86) PCT No.: PCT/US2011/052618

§ 371 (c)(1),
(2), (4) Date: May 16, 2013

(87) PCT Pub. No.: WO2012/040370

PCT Pub. Date: Mar. 29, 2012

(65) Prior Publication Data

US 2013/0225047 A1 Aug. 29, 2013

Related U.S. Application Data

(60) Provisional application No. 61/384,966, filed on Sep. 21, 2010.

(51) Int. Cl.

| | |
|---|---|
| ***B24B 33/10*** | (2006.01) |
| ***B24B 33/02*** | (2006.01) |
| ***B24B 55/02*** | (2006.01) |

(52) U.S. Cl.
CPC ..... *B24B 33/105* (2013.01); *B24B 33/027* (2013.01); *B24B 55/02* (2013.01)

(58) Field of Classification Search
CPC ..... B24B 33/105; B24B 33/08; B24B 33/03; B24B 55/02
USPC ..... 451/5, 478, 481
See application file for complete search history.

(56) References Cited

U.S. PATENT DOCUMENTS

| | | | | |
|---|---|---|---|---|
| 5,800,252 | A | 9/1998 | Hyatt | |
| 6,739,949 | B2 | 5/2004 | Becksvoort et al. | |
| 7,070,491 | B2 * | 7/2006 | Becksvoort | B24B 33/105 451/470 |
| 2007/0298685 | A1 * | 12/2007 | Cloutier | B23Q 17/2233 451/5 |

* cited by examiner

*Primary Examiner* — Monica Carter
*Assistant Examiner* — Lauren Beronja
(74) *Attorney, Agent, or Firm* — Matthews Edwards LLC

(57) ABSTRACT

A honing tool holder utilizes pressure of a through-the-spindle coolant delivery system for automatically feeding the honing elements or stones of an attached honing tool when in the bore of a work piece, and for automatically stopping the feeding when a particular condition such as a bore size, is reached, so as to enable use of an in-process adjustable feed honing tool in a machine tool, machining center, or the like, lacking a feed mechanism or system but including a coolant delivery system. The holder can also include apparatus to automatically prevent feed past a limit. Both the feed force and feed limit can be adjustable, at least the latter by simple movements of the tool holder by the machine tool.

11 Claims, 9 Drawing Sheets

HONING TOOL HOLDER WITH A FEED SYSTEM POWERED BY THROUGH-THE-SPINDLE COOLANT PRESSURE AND ACTUATED BY SPINDLE ROTATION

This application is submitted under 35 U.S.C. 371 claiming priority to PCT/US2011/52618, filed Sep. 21, 2011, which application claims the benefit of U.S. Provisional Application No. 61/384,966, filed Sep. 21, 2010.

TECHNICAL FIELD

The invention relates generally to a honing tool holder, and more particularly, that is adapted for mounting in a rotatable spindle of a machine tool or machining center lacking a feed system, but as is common, does have a means to deliver pressurized coolant through the center of the spindle, the holder being capable of holding and automatically operating an in-process adjustable feed honing tool for honing a work piece to a desired diameter or other characteristic, using the coolant pressure to deliver a constant force to the wedge element of the honing tool.

BACKGROUND ART

U.S. Provisional Application No. 61/384,966, filed Sep. 21, 2010, is incorporated herein by reference in its entirety.

Machine tools and machining centers, hereinafter sometimes jointly referred to by the term "machine tool", including, but not limited to, milling machines and the like, include rotatable spindles configured for holding tools such as milling cutters, drills, reamers, and the like, for performing machining operations, such as but not limited to, milling, drilling, boring, and reaming. Such tools are typically removably held in the spindle by tool holders, which allow quickly changing the tools, for instance, by an automatic tool changing apparatus. Honing is a machining operation that can impart a much more precise size, shape, and finish to work piece bores, but many traditional honing tools require a feed mechanism or system for adjusting a feed position and/or feed force of honing elements, e.g., abrasive stones, of the tool, in process, as those elements are urged against the surface of a bore of a work piece for honing the bore. Known machine tools and machining centers lack the required feed system or mechanism, and thus the traditional in process adjustable feed honing tools have not been used on machine tools. But many machine tools and machining centers have through-the-spindle coolant delivery systems operable for directing a flow of liquid coolant from a port or orifice in the spindle, into a mating port or orifice of a tool holder held by the spindle.

There exist several honing tools designed for use in machine tools that utilize through-the-spindle coolant pressure to directly or indirectly force the abrasive stones of the honing tool into the surface of the bore. Reference in this regard, Hyatt, et al. U.S. Pat. No. 5,800,252, which describes a honing tool designed for use in a machine tool having through-the-spindle coolant. In the Hyatt, et al. tool, by means of passages the coolant pressure is supplied directly to chambers under the abrasive stones providing direct force. However, an observed shortcoming is that this type of tool allows each abrasive stone to feed independently which will not reliably improve the roundness of a bore, which is often a goal of the honing process. Usually, roundness is accomplished by having abrasive stones fed by a single wedge that keeps all stones advancing and retracting in unison.

U.S. Pat. No. 6,739,949 B2, Becksvoort, et al. and U.S. Pat. No. 7,070,491 B2, Becksvoort et al, both describe a honing tool with a wedge that is fed by the pressure of coolant delivered through the machine tool spindle. Both of these tools, however, rely on an internal helical spring to retract the tool. Spring force naturally is increased as the abrasive stones are fed outward. The net force delivered to the wedge is the coolant force minus the spring force. This results in a variation of the feeding force supplied to the wedge. Although in theory this could be compensated for by adjusting the coolant pressure, a reliable feedback loop would be required to do so, and in absence of such a feedback loop the feed force will be diminishing over time as the abrasive stones wear. Even during the travel of a single honing cycle the net feed force will drop as the wedge feeds against the retraction spring.

As an additional limitation, none of the known prior art discussed above includes a means to detect when the honing operation has achieved the desired bore size. Honing is typically performed for a set period of time, or some external means of in-process bore gauging must be employed.

As another observed limitation, none of the above referenced prior art discloses a manner of using traditional in-process adjustable feed honing tools on the spindle of a machine tool or machining center.

Thus, what is sought is a honing tool holder that provides a capability for automatically feeding the honing elements or stones when in the bore of a work piece, and for automatically stopping the feeding when a particular condition such as a bore size, is reached, to enable use of an in-process adjustable feed honing tool in a machine tool, machining center, or the like, lacking a feed mechanism or system, but including a through-the-spindle coolant delivery system.

SUMMARY OF THE INVENTION

What is disclosed is a honing tool holder that utilizes a through-the-spindle coolant delivery system, for automatically uniformly feeding the honing elements or stones when in the bore of a work piece, and for automatically stopping the feeding when a particular condition such as a bore size, is reached, to enable use of an in-process adjustable feed honing tool in a machine tool, machining center, or the like, lacking a feed mechanism or system.

According to a preferred aspect of the invention, the tool holder has a body having a mounting element for cooperatively mounting the tool holder on a spindle of a machine tool for rotation therewith about a rotational axis therethrough, and a tool holding element opposite the mounting element configured and operable for cooperatively holding a honing tool for rotation about the rotational axis. The tool holder has a feed system carried on the body, configured to connect to a feed element of a honing tool held by the tool holding element, the feed system including a biasing element configured and operable upon occurrence of a predetermined condition, to automatically direct pressure from a pressurized fluid flow received from the spindle to exert a feed force against the feed element to urge honing elements of the tool radially outwardly relative to the tool, and apparatus configured and operable to automatically prevent radial movement of the feed element of the honing tool past a limit. The condition is preferably rotation of the tool holder, and the movement is preferably prevented by preventing the pressurized fluid flow from acting on the biasing element in a feed direction. This is accomplished with a valve mechanism that is centrifugally actuated by the rotation of the tool holder.

As an advantage of the invention, the tool holder allows honing tools to be interchangeable between a honing machine and another type of machine tool not specifically designed for honing, providing the non-honing machine the capability of using honing tools that have already been optimized for the honing process.

As another advantage, the honing element or elements of the honing tool can be uniformly fed, in the same manner as if used on a dedicated honing machine having a conventional feed system.

DETAILED DESCRIPTION OF THE INVENTION

Figure 1:
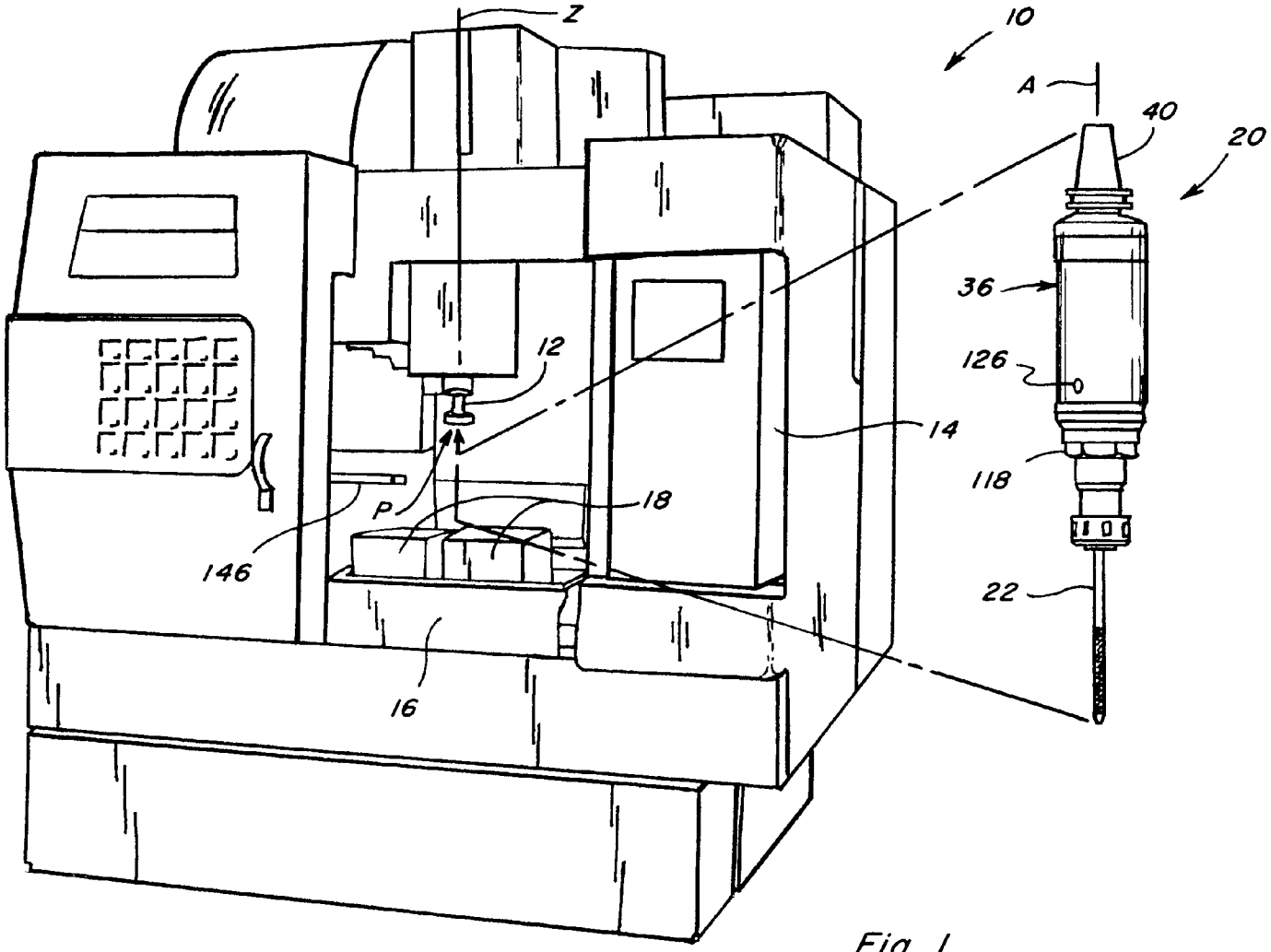
FIG. 1 is a perspective view of a representative machine tool having a rotatable spindle with through-the-spindle coolant delivery, and a honing tool holder of the invention for installation in the spindle of the machine tool, and showing a representative honing tool held in the holder.

Referring now to the drawings, in FIG. 1, a conventional computer numerical control or "CNC" machine tool 10 is illustrated, including a vertical spindle 12 of well-known construction and operation. Spindle 12 is automatically controllably rotatable about a vertical rotational axis Z, and movable upwardly and downwardly along axis Z, by a controller 14 of machine tool 10, in the well-known manner. Machine tool 10 additionally includes a table 16 controllably movable horizontally along an X axis and a Y axis by controller 14, and configured and operable for supporting one or more or fixtures 18 for holding a work piece or work pieces on which work operations will be performed by machine tool 10. Controller 14 is of conventional construction and operation, and is a microprocessor controlled device automatically operable for executing a machining program for controlling spindle 12 and table 16 for performing the machining operations in the well-known manner. Such operations conventionally include, but are not limited to, milling, drilling, boring, reaming, threading, and the like. The respective operations are performed using tools specialized for the operations, which are held by tool holders insertable into and held by spindle 12, also in the well-known manner. Machine tool 10 will additionally usually include a tool changer (not shown) configured and operable for automatically inserting the respective tools into spindle 12 for commencement of operation, and removing of the tools after the operation is complete, also under control of controller 14. A honing tool holder 20 constructed and operable according to the teachings of the present invention, is illustrated as being insertable into spindle 12 for rotation and upward and downward movement thereby. Honing tool holder 20 is illustrated holding a honing tool 22. Here, it should be noted that although rotational axis Z is illustrated as a vertical axis, the present invention is also configured for operation and other orientations, including, but not limited to, a horizontal axis.

Figure 2:
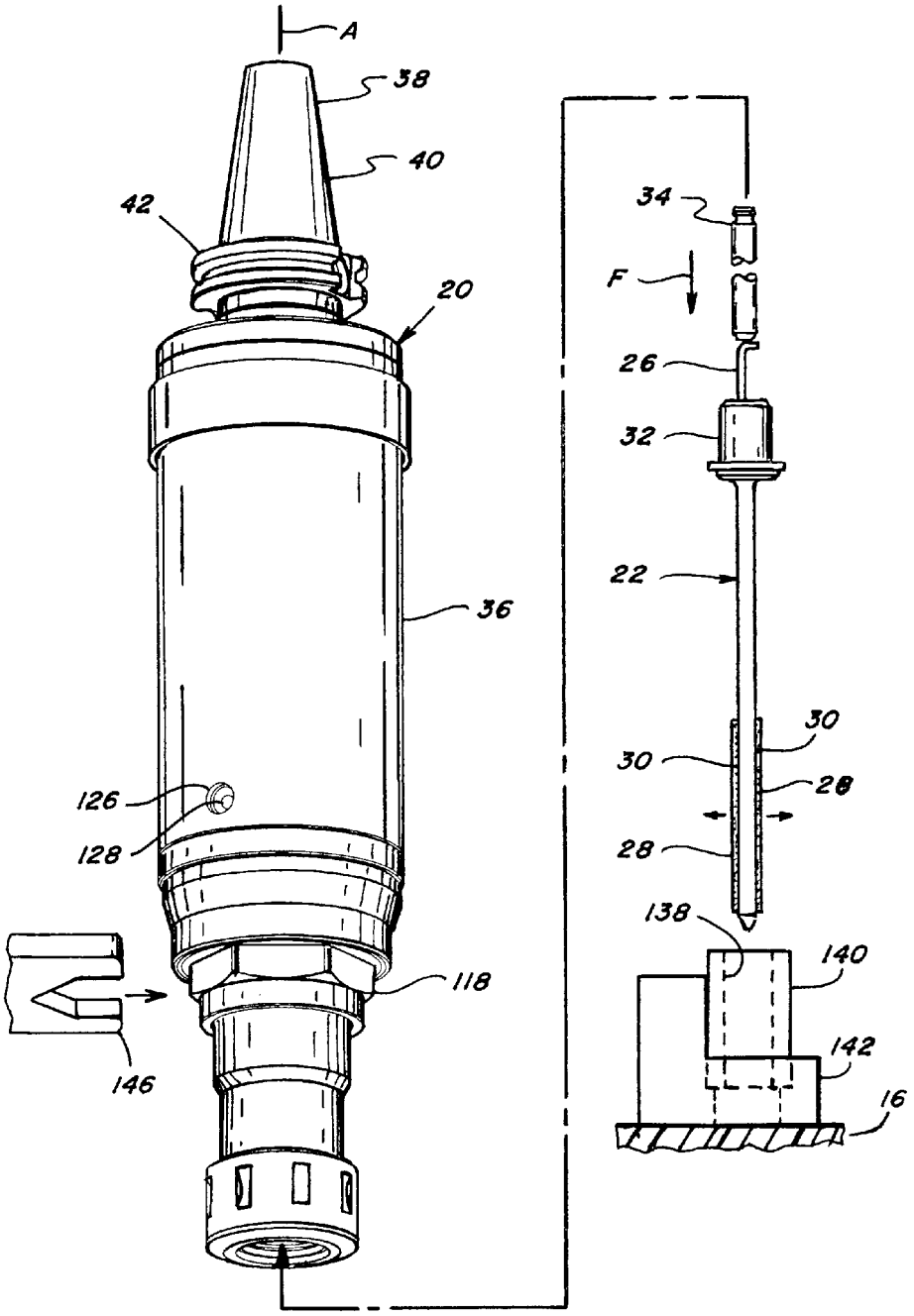
FIG. 2 is an enlarged perspective view of the honing tool holder of FIG. 1, showing the honing tool removed therefrom to reveal mounting and feed elements thereof.

Referring also to FIG. 2, honing tool 22 is representative of a wide variety of in-process adjustable feed honing tools including an elongate, hollow mandrel 24 which receives and carries a feed or wedge element 26 for longitudinal movement therein. Wedge element 26 has one or more wedge surfaces (not shown) located within mandrel 24 and which bear against mating wedge surfaces (also not shown) on honing elements 28 extending through slots 30 through the sides of mandrel 24 at angularly spaced locations thereabout. In operation, movement of wedge element 26 longitudinally into mandrel 24 (downwardly as depicted by arrow F in FIG. 2) will cause sliding relative movements of the wedge surfaces, which, in turn, will cause uniform radial outward movement or feed of honing elements 28, as denoted by the small arrows emanating radially from elements 28. Movement of the wedge element longitudinally outwardly relative to the mandrel (opposite of direction F) will allow the honing elements to radially retract. If in a work piece bore, once the honing elements are radially moved outwardly so as to contact the surface of the bore, application of a force in direction F against the wedge element, commonly referred to as a feed force, will act to transmit a radial outward force against the honing elements, which will be exerted against the surface of the work piece bore. The honing elements will comprise an abrasive substance, in the form of a stone or layer of abrasive particles, selected to achieve a desired honing or bore finishing effect, such as, but not limited to, a particular bore size, surface finish, trueness or concentricity, shape, or the like.

Honing tool 22, like many other in-process adjustable honing tools, has a mounting end 32 of a standard shape and size suitable for insertion into and retention by a honing machine spindle. At the same time, a wedge coupler 34 on the end of wedge element 26 is connectable to a feed rod of a feed mechanism located within the spindle of the honing machine and controllably movable in direction F and the opposite direction. In typical operation, at an appropriate time or times in the honing cycle or operation, the feed rod of the honing machine will be moved in direction F relative to the mandrel of the honing tool, to bring the honing elements into contact with the surface of the bore of a work piece in which the tool is located, and the feed force applied, during relative rotation and stroking of the tool and work piece, to effect honing the bore surface. Upon completion of a desired honing step or operation, the feed rod will be moved in the opposite direction, to remove the feed force and the tool can be withdrawn from the bore, or another honing operation performed.

Feed mechanisms similar to those of conventional honing machines as just described, are not present in the spindles of other machine tools, such as milling machines, machining centers, and the like, such as representative machine tool 10 illustrated. As a result, in-process adjustable feed honing tools such as tool 22 are normally not usable with a conventional, non-honing type machine tool or machining center such as machine tool 10. However, many machine tools such as machine tool 10 will include a through-the-spindle coolant delivery system that pumps pressurized coolant fluid, such as, but not limited to, a commercially available water or oil based liquid coolant, through spindle 12, so as to be discharged from a port P within the spindle, in a well-known manner.

Honing tool holder 20 remedies the above shortcoming with regard to a lack of a feed system, by including an integrated feed system which has a capability to utilize the pressure of the through-the-spindle coolant feed to provide feed force, and which will automatically initiate feeding of the honing elements at a desired point in the honing process, and stop the feeding when a limit is reached. Honing tool holder 20 also has the capability to automatically output a signal indicating the reaching of the limit, such that the honing cycle or operation can be halted, altered, or other step taken. FIGS. 1 and 2 show that the tool holder 20 has a relatively large body 36 including a mounting end 38 having a tapered shank 40 made to a standard connection specification (such as, but not limited to, CAT, HSK, etc.) so as to be installable in the manner of a conventional tool holder in a matching collet of the spindle of a machine tool or machining center including a through-the-spindle coolant delivery system, but not including a feed system or mechanism, as represented by spindle 12 of machine tool 10. Mounting end 38 of tool holder 20 additionally includes a flange 42 about mounting end 38 adjacent to tapered shank 40 and adapted for engagement with a conventional tool changer operable for installing and removing tool holder 20 from a spindle, such as spindle 12. When installed in a spindle, such as spindle 12, a central axis A of tool holder 20 will be coaxial with a rotational axis of the spindle (here, rotational axis Z), and tool holder 20 will be rotatable and movable upwardly and downwardly with the spindle.

Referring also to FIGS. 3 through 9 which show elements of tool holder 20, within the top of body 36, disposed within flange 42 and adjacent mounting end 38, are elements of a feed system 44 completely contained on tool holder 20 and configured to receive pressurized fluid coolant from in-the-spindle port P of a spindle to which the holder is mounted (here, spindle 12), and connect or couple to and operate a feed element of a honing tool held by the tool holding element (here, wedge element 26 of honing tool 22 via connection with coupler 34). Feed system 44 includes a fluid pressure operated biasing element 46 configured and operable upon occurrence of a predetermined condition, to automatically direct a pressurized fluid flow received from port P of spindle 12 as a feed force against the feed element (wedge element 26 of tool 22) via a feed rod assembly 100 (described in detail below) to urge honing elements 28 of the tool radially outwardly relative to the tool. Feed system 44 also includes apparatus configured and operable to automatically prevent the radial movement of the feed element of the honing tool and thus honing elements 28 past a limit. Still further, feed system 44 additionally includes a release mechanism 48 configured and operable to utilize the fluid pressure to automatically hold the feed element in a retracted position and prevent the exertion of the feed force against wedge element 26 until a predetermined condition occurs, which here is initiation of rotation of tool holder 20, as will be explained.

Biasing element 46 of feed system 44 includes a feed piston assembly 50 which consists of a piston 52 carried in a cylinder bore 54 of a cylinder housing 56 carried in body 36. An upper first end of cylinder bore 54 is covered by an orifice plate 58 which also bounds and defines the lower extent of a radially extending release valve passage 60 within body 36 which is a part of release mechanism 48. The upper extent of valve passage 60 is bound by a flange 62 having a threaded receptacle which threadedly receives a lower end of shank 40. Shank 40 includes a connecting passage 64 therethrough which, when installed in a spindle such as spindle 12 having through-the-spindle coolant delivery, connects via an inlet orifice 66 with release valve passage 60 on the lower end and with port P of the spindle on the upper end, as evident in FIGS. 4, 5, and 6.

Release mechanism 48 is preferably centrifugal force operated and includes a release valve element 68 disposed in release valve passage 60 and movable radially between a first position (FIG. 3) adjacent and slightly eccentric to the axial center, and thus to the center of rotation, of tool holder 20, and a second position (FIGS. 4, 5, and 6) radially outwardly of the first position and thus more eccentric to the axial center. Valve element 68 is biased toward the first position by a biasing spring 70 disposed between a portion of body 36 enclosing the radial end of passage 60 and valve element 68. Suitable spacer blocks 72 (FIG. 7) define the lateral sides of passage 60. Valve member 68 is a two way valve member and includes a first passage 74, and a second passage 76, therethrough.

When in the first position, which comprises a retract mode of release mechanism 48, first passage 74 is aligned with and connects inlet orifice 66 with a bypass port 78 extending through orifice plate 58 and cylinder housing 56 to a lower end 80 of cylinder bore 54, below piston 52. A ball check valve 82 is located in port 78, oriented to allow flow to lower end 80, but not in the opposite direction. When in the second position, which comprises a feed or release mode of mechanism 48, second passage 76 is aligned with inlet orifice 66 and a feed port 84 through orifice plate 58 in an upper end 86 of cylinder bore 54. A connecting port 86 extends through piston 52 or another suitable path between lower end 80 and upper end 86 of cylinder bore 54, and includes a ball check valve 90 operable to allow flow from upper end 86 to lower end 80, but not in the reverse direction.

Figure 3:
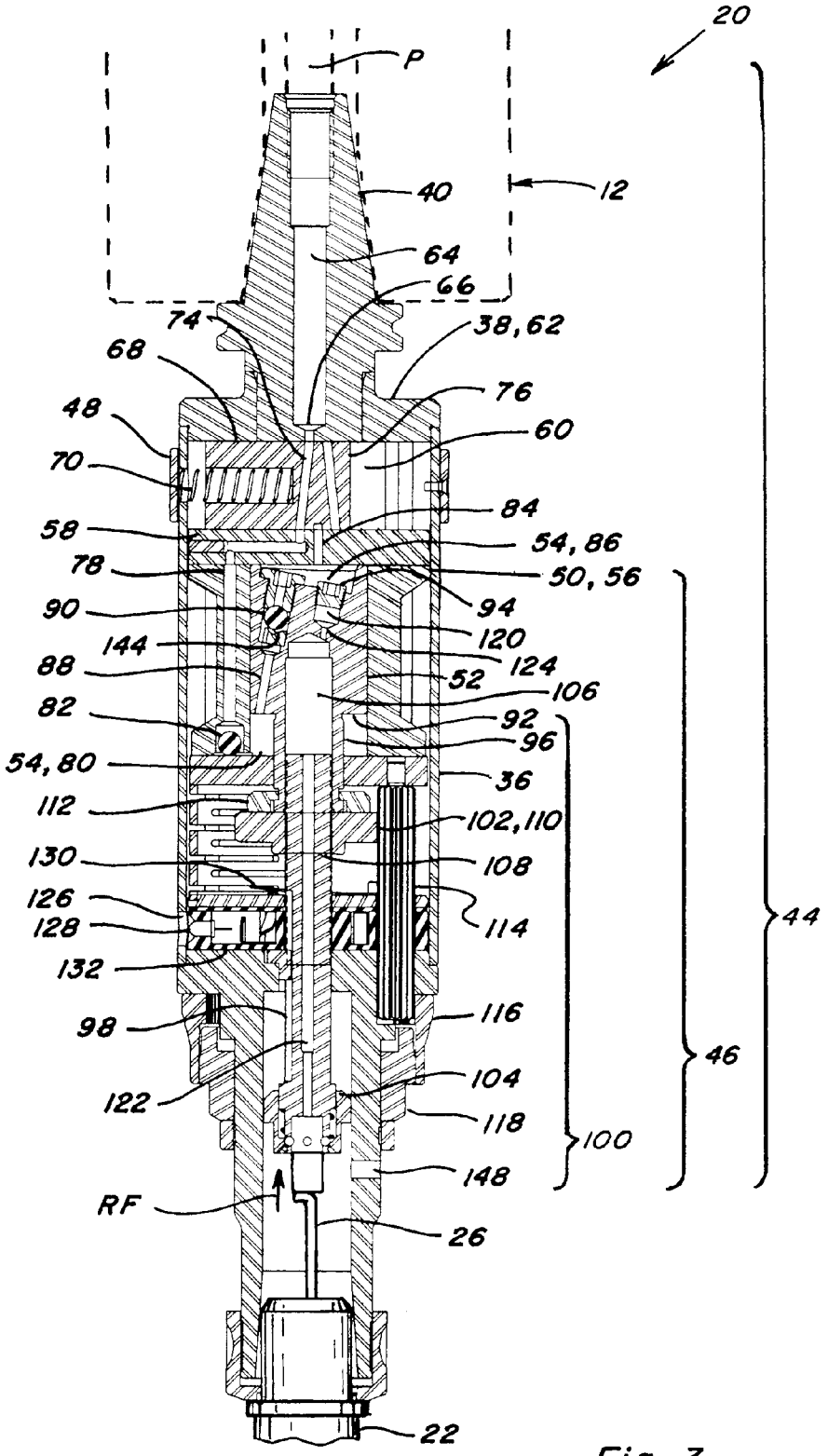
FIG. 3 is an enlarged sectional view of the tool holder, without a honing tool held therein, and in a non-rotated state.
Figure 4:
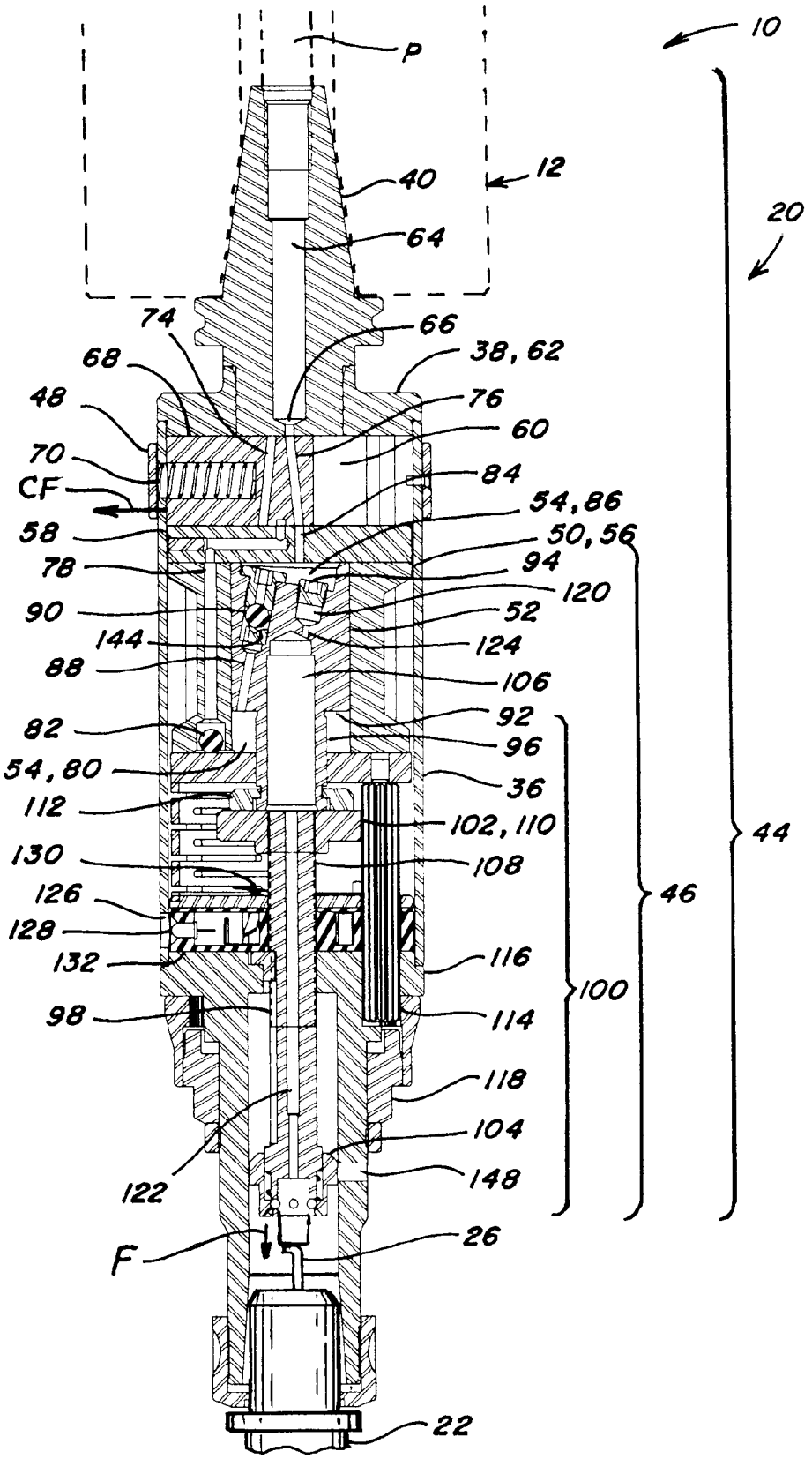
FIG. 4 is another enlarged sectional view of the tool holder, in a first pressurized state representative of when installed in a spindle and rotated.

When release valve element 68 is in the first position, the pressurized fluid from port P of the spindle will fill and pressurize port 78 and lower end 80 of cylinder bore 54, to maintain piston 52 in an upper position, shown in FIGS. 3 and 4.

When valve element 68 is in the second position, the fluid from port P will fill and pressurize the upper end 86 of bore 54. The pressurized fluid will also be able to flow, and the pressurization will be communicated, through check valve 90 and connecting port 88 from upper end 86 to lower end 80. Thus, the pressurized condition will exist in bore 54 on both ends of piston 52.

Here it should be observed that piston 52 has a lower axially facing surface 92 in lower end 80 of bore 54 having an annular shape with an outer diametrical extent bounded by the surface of bore 54, and an upper axially facing surface 94 that is circular, but of the same outer diametrical extent as lower surface 92. The lower end of piston 52 additionally includes a downwardly projecting portion that serves as an upper feed rod 96 of feed rod assembly 100. As a result, it can additionally be observed that lower axially facing surface 92 has a smaller sectional area than upper axially facing surface 94, which will be important for reasons discussed below. The check valve 90 may be configured upon assembly, via an inversion of the seat 144 below the check ball, to be permanently in a closed position. In this case the second position described in the previous paragraph will result in only the top side of piston 52 being pressurized. This will allow for a greater force to be applied to the feed rod assembly 100. The decision regarding whether check valve 90 is installed as active or as permanently locked is dependent on the feed force requirements of the honing application. Users of this device, with training on proper disassembly and assembly of the device may thereby change the feed force range of the tool holder from one of lower force capability to one of higher force capability.

Feed rod assembly 100 additionally includes a lower feed rod 98 that extends downwardly through an inner passage of tool 20 to a coupler 104 for coupling to wedge coupler 34 of a tool such as tool 22 held by holder 20 on the lower end. An access hole 148 is preferably provided at this location that allows an operator to insert a tool to release coupler 104 for honing tool installation and removal.

The invention preferably includes apparatus operable to automatically prevent radial movement of the honing elements of the tool and thus the final honed size, past a limit. This apparatus additionally preferably enables adjusting the final honed size or other characteristic, and/or adjusting for the wear of the abrasive honing elements of the honing tool. In a preferred embodiment to provide these capabilities, lower feed rod 98 is mounted to upper feed rod 96 by a feed adjusting element 102. The upper end of lower feed rod 98 is telescopingly receivable in a passage 106 extending axially upwardly from the lower end of upper feed rod 96 and into piston 52. Feed adjusting element 102 has a threaded hole 108 therethrough aligned with passage 106 and threadedly receives the upper end of lower feed rod 98 which is threaded for this purpose. Adjusting element 102 additionally has an adjusting gear 110 about its outer circumference, and a retaining flange 112 on its upper end. Retaining flange 112 rotatably attaches adjusting element 102 and gear 110 to the lower end of upper feed rod 96. Gear 106 engages a pinion 114 that in turn engages a ring gear 116 at its lower end. Ring gear 116 is fastened to a feed position adjustment nut 118 rotatably disposed about the lower end of body 36, so that a measured turn of nut 118 will rotate ring gear 116 to rotate pinion 114, which in turn will rotate adjusting gear 110, to threadedly engage lower feed rod 98 to move it upwardly or downwardly within and relative to feed adjusting element 102. Adjusting element 102 is connected to upper feed rod 96, such that the upward and downward movement of lower feed rod 98 will also be relative to upper feed rod 96, so as to effectively shorten or lengthen feed rod assembly 100, which will translate to adjustment movements of a wedge element 26 coupled to lower feed rod 98 via coupler 104, which will adjust final bore size achieved by honing elements 28 of a tool held by holder 20.

To provide coolant flow to a honing tool, it can be observed that piston 52 has an additional, optional passage 120 therethrough, connecting with passage 106. Lower feed rod 98 additionally includes an optional passage 122 therethrough (plugged in FIGS. 3, 4, and 5) connecting passages 106 and 120 with coupler 104. As a result, when unplugged, as shown in FIG. 6, a continuous flow path will exist from the upper end 86 of the cylinder bore to a tool held by holder 20. This path can be used to communicate the pressurized fluid in the bore to the tool for cooling, lubricating, and flushing purposes. This path can also optionally have a restricting orifice 124 therein, to restrict or meter the flow of coolant, if desired, and help maintain a desired feed force.

As another feature of the invention, a window 126 in the side of tool holder exposes an LED 128 (visible or infrared), or a radio frequency transmitter. When feed adjusting element 102 reaches a position corresponding with the final bore size, a limit switch 130 will change state. Switch 130 is part of a sealed unit 132 located within body 36 and containing batteries 134, a circuit 136 and LED 128, configured and operable for outputting a signal, denoted by arrow S, indicative of feed system 44 having reached a predetermined settable feed limit. When switch 130 is contacted by element 102 it closes the circuit 136 to provide power from batteries 134 to the LED (and/or optionally an RF transmitter) to send the signal S to a receiver of, or in connection with, controller 14 of machine tool 10 as an indication that the final size and/or other characteristic of a bore 138 of a work piece 140 being honed (FIG. 9) located in a fixture 142 has been reached. Controller 14 then stops the honing cycle, e.g., by stopping spindle rotation and by withdrawing honing tool 22 from the work piece bore, or performs some other programmed command.

As the abrasive stones or other honing elements wear, feed rod assembly 100 must be adjusted. As explained above, adjustment nut 118 on the outside of tool holder 20 can be turned relative to body 36 of the tool holder to lengthen or shorten the effective length of feed rod assembly 100. This can be accomplished by programmed operation of machine tool 10 which will move table 16 and spindle 12 as required to set tool holder 20 into a "nest" including parallel planes 146 (FIG. 2) that mate with parallel sides of nut 118. (e.g. like a traditional open-end wrench fixed to some location on the machine tool table.) Machine tool 10 will then rotate spindle 12 (with the tool holder 20) by a precise angle corresponding to the amount of feed adjustment required.

Figure 5:
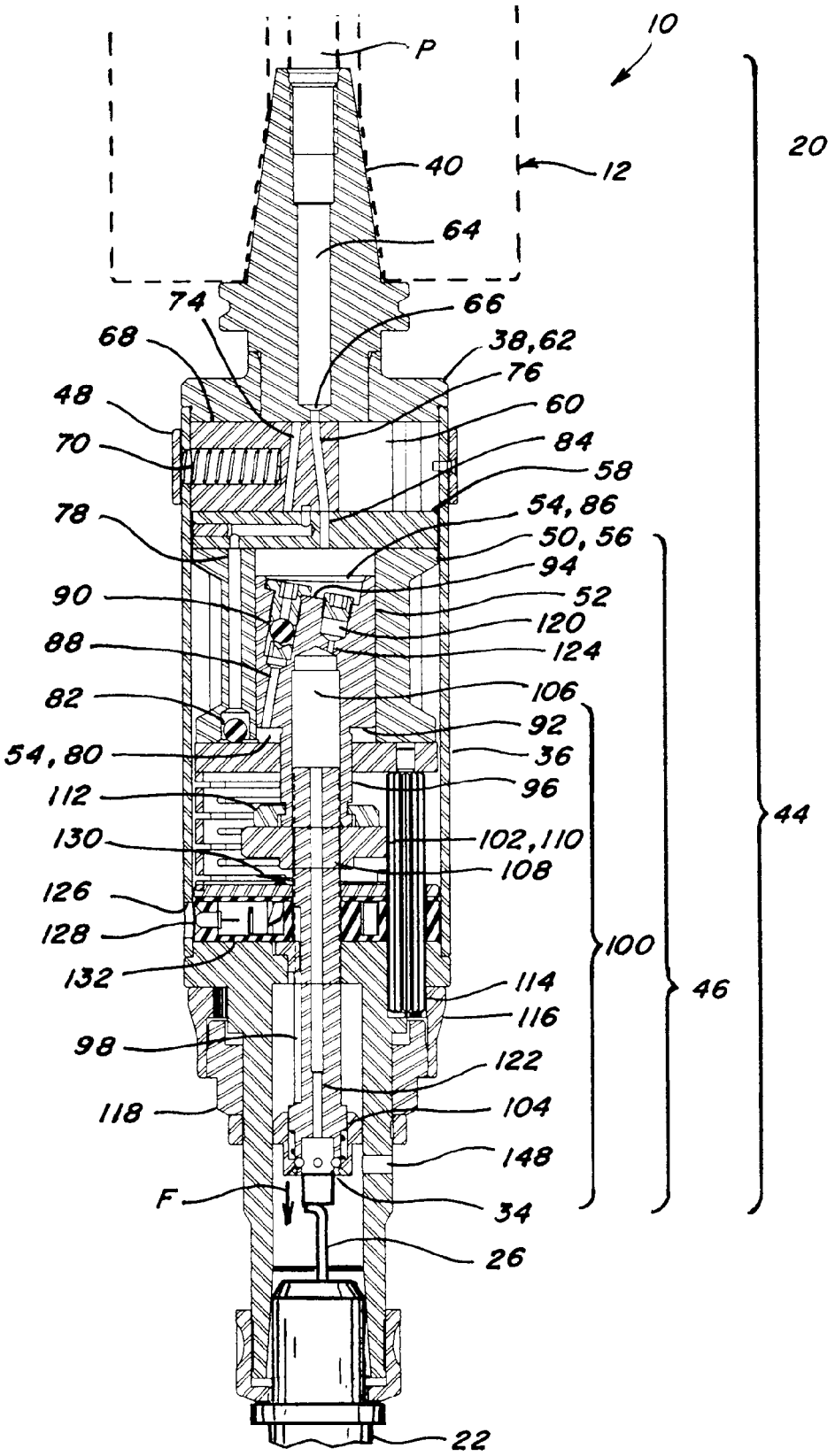
FIG. 5 is another enlarged sectional view of the tool holder, showing a feed rod assembly of the holder adjusted to a different length.
Figure 6:
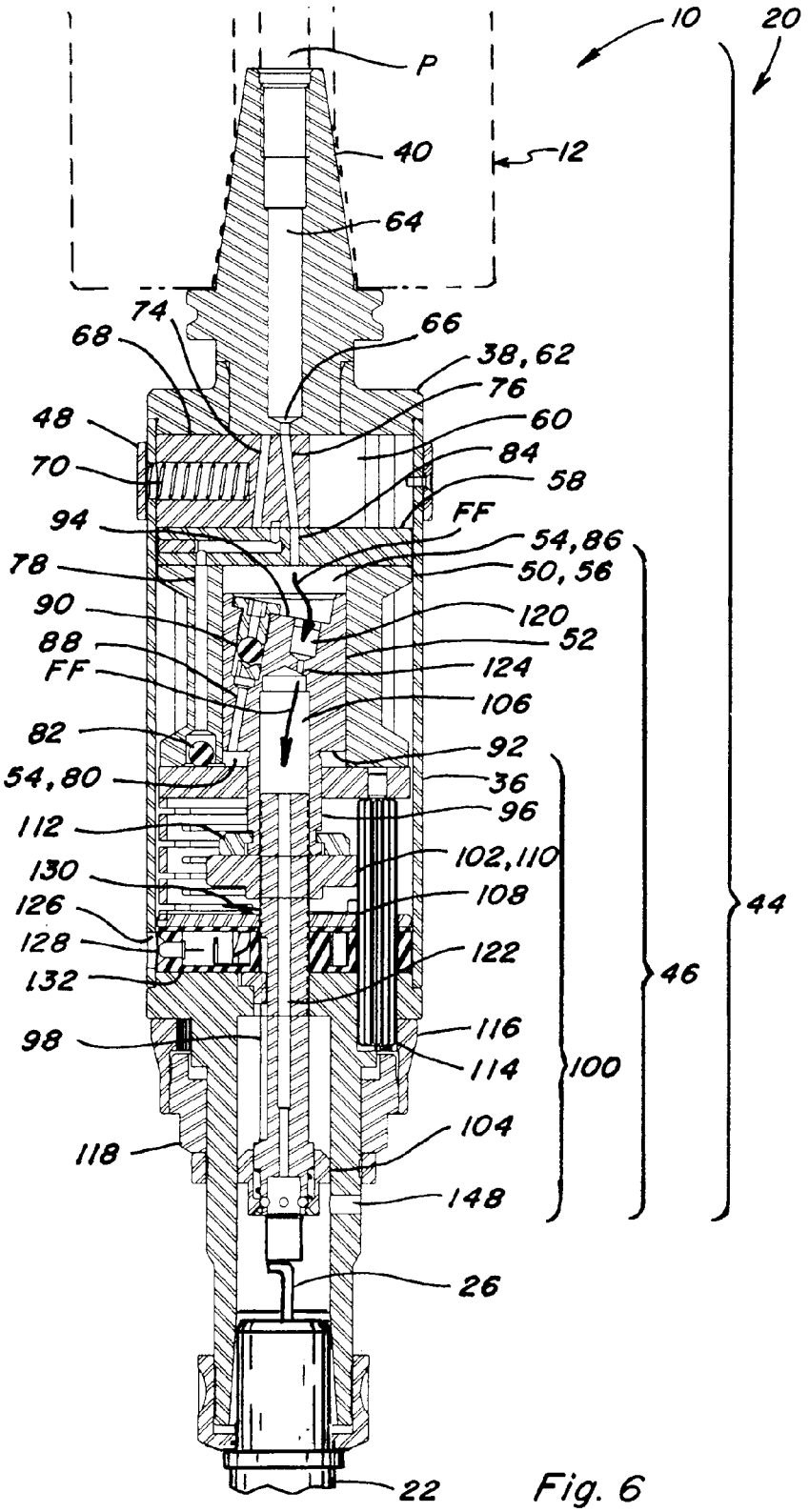
FIG. 6 is still another sectional view of the tool holder, showing an alternative orifice configuration.
Figure 7:
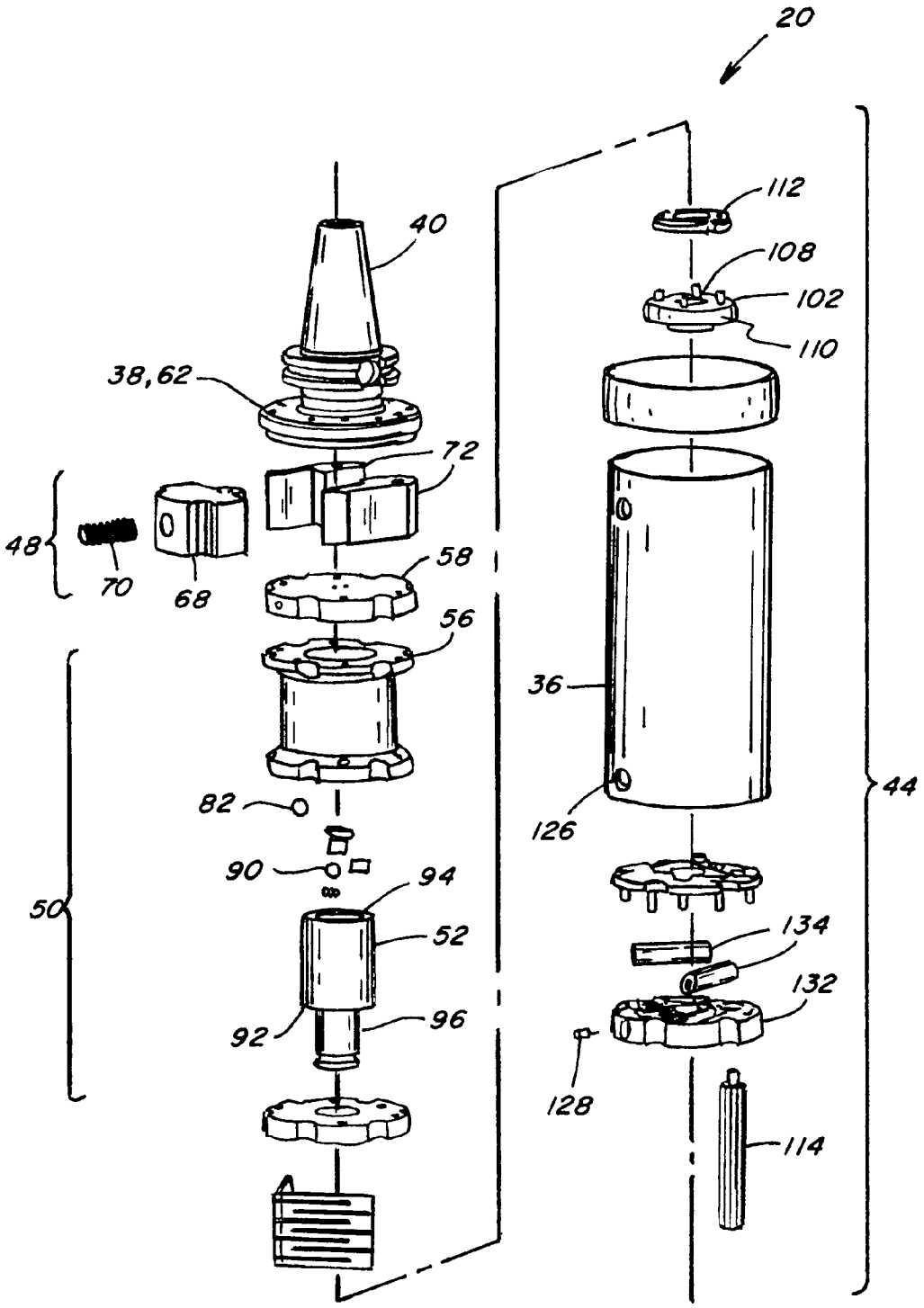
FIG. 7 is an exploded perspective view of upper elements of the tool holder.
Figure 8:
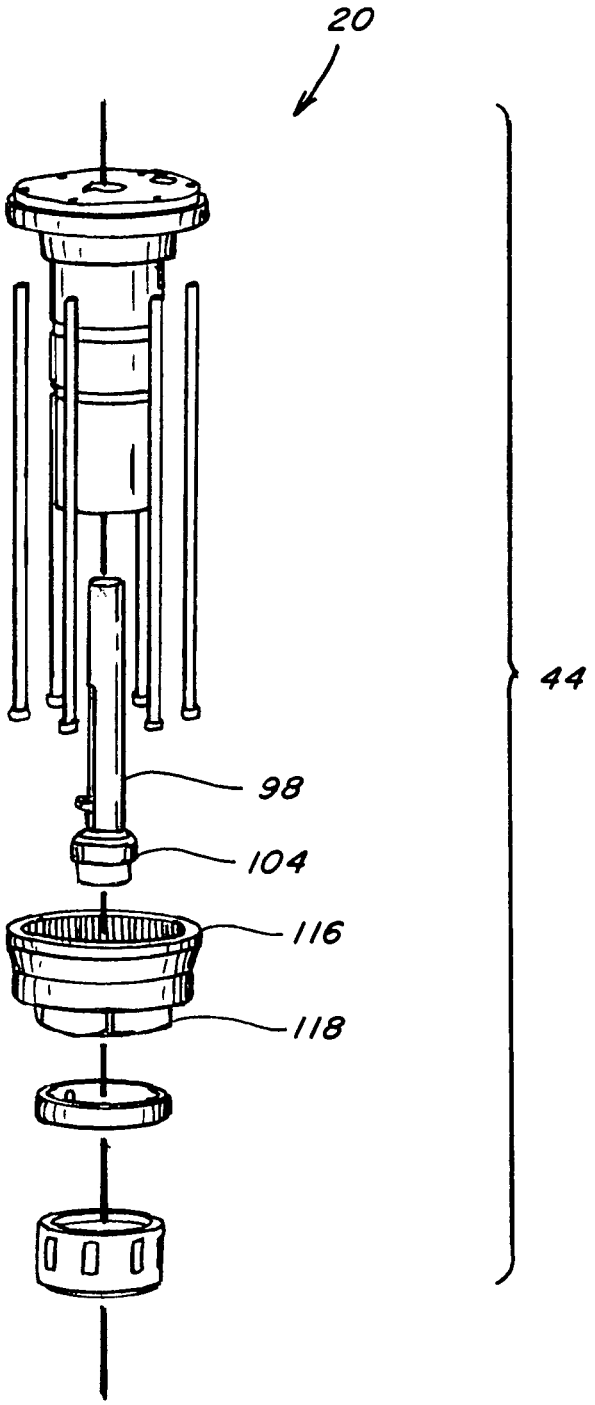
FIG. 8 is a continuation of FIG. 7, showing lower elements of the tool holder.
Figure 9:
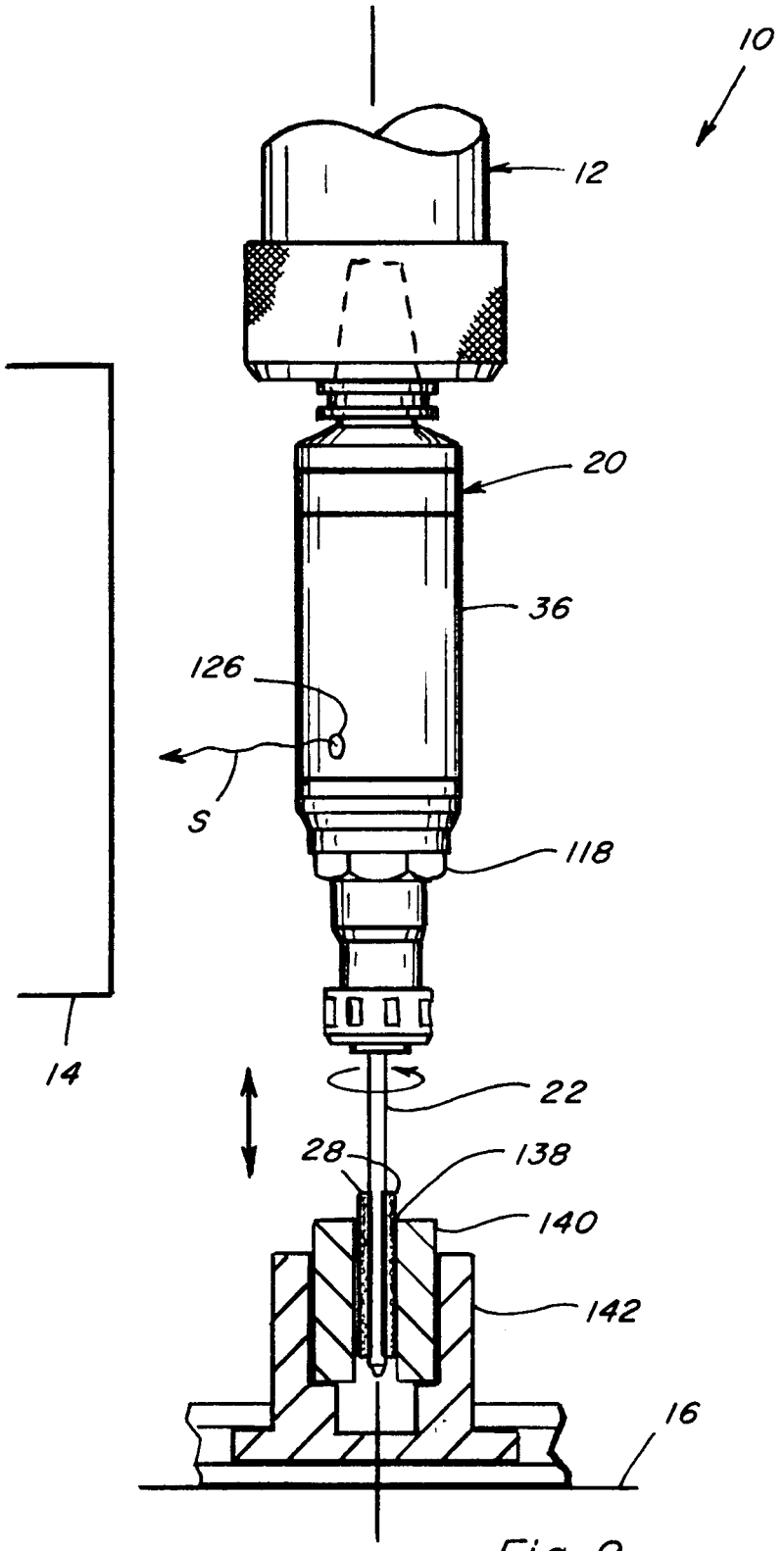
FIG. 9 is a simplified schematic side view of the tool holder of the invention, in operation holding a honing tool and stroking the tool in a bore of a work piece.

The complete operation of tool holder 20 is best seen by examination of FIGS. 3, 4, and 5. FIG. 3 illustrates the state of tool holder 20 when not loaded in a spindle, and when located in a spindle but not rotating. In this state, if held in a spindle, such as spindle 12, and through-the-spindle coolant is supplied via port P of the spindle, the fluid will flow from port P through connecting passage 64 through shank 40 and inlet orifice 66, to centrifugally actuated release valve element 68 of release mechanism 48. Because tool holder 20 is not sufficiently rotating at this time, release valve element 68 will have no centrifugal force acting against it, and thus will be held by biasing spring 70 in the first or retracted position shown. This aligns first passage 74 with bypass port 78, such that the pressurized fluid will be communicated to lower end 80 of cylinder bore 54. Feed port 84 is thus not directly connected to port P of the spindle. This pressure creates a retracting force RF, which urges piston 52, feed rod assembly 100, and a wedge element of a honing tool held by the holder, upwardly toward their retracted positions, which serves to also retract the honing elements of the tool. This mode has utility, for instance, when not honing, and when inserting the honing tool into a work piece bore.

FIGS. 4 and 5 illustrate the state of tool holder 20 when rotated sufficiently to automatically centrifugally actuate release mechanism 48. In this state, the rotation generates sufficient centrifugal force, denoted by arrow CF, acting on release valve element 68 to urge it radially outwardly to its second or feed position shown. Now, second passage 76 of the valve element is aligned with inlet orifice 66 and feed port 84 in connection with upper end 86 of cylinder bore 54. Bypass port 78 is now disconnected from direct communication with inlet orifice 66 and port P of the spindle. In this configuration, the pressurized fluid is communicated from port P of the spindle directly to the upper end 86 of the bore. Additionally, the pressurized condition may be communicated via connecting port 88 to lower end 80 of the bore, as determined by the assembled configuration of check valve 90. Because of the difference in size of axially facing surfaces 92 and 94 of piston 52 (upper surface 94 is larger) acted on by the pressurized fluid in lower end 80 and upper end 86, respectively, of bore 54, a differential feed force is exerted against piston 52 in the downward direction. This is transmitted through feed rod assembly 100 as feed force F acting against wedge element 26 of tool 22 coupled thereto, which in turn serves to urge honing elements 28 of the tool radially outwardly as depicted by the small arrows in FIG. 2. If in the bore of a work piece such as bore 138 of work piece 140 shown in FIG. 9, this will provide the required feed force for honing the surface of the bore.

In FIG. 6, the plug is removed from passage 120 of piston 52, to allow the fluid to flow through the piston to passage 122 downwardly through the feed rod assembly 100, as denoted by arrow FF. This fluid is delivered through coupler 104 to the honing tool, and can travel through internal passages of the tool to provide cooling and lubrication, and can exit through coolant ports (not shown) of the tool and/or slots 30 (FIG. 2), to cool the work area and flush particles, in the well known manner.

During the honing operation, piston 52 and feed adjusting element 102 move slowly downward as the abrasive honing elements are radially expanded by the feed force F. Eventually, element 102 will advance to limit switch 130. Switch 130 is encased in sealed unit 132 which is automatically operable to energize LED 128 to output a signal indicative of the position of element 102 to controller 14, and thus the position of honing elements 28 connected thereto.

Machine tool 10 will be programmed for performing the reciprocating motion and relative rotation of the tool and work piece of a typical honing cycle. That programmed cycle will be allowed to continue until the signal is received from the transmitter (e.g., LED 128 on tool holder 20, or RF signal, etc.). Additionally, the program should include logic to stop a cycle after a maximum time has been reached as an indication that the abrasive honing elements are worn out or no longer in a condition to cut effectively.

The control program should also allow for bore size compensation as follows: A manually entered tool comp value would be used by the program to adjust the tool size accordingly. A known approximate honing element or stone wear rate entered by the operator would result in an automatic adjustment of the tool by that amount before each honing cycle. An external gauging device (air gauge, or similar) could feed back information to the machine control system for purposes of adjusting tool size and possibly adjusting the stroke of the honing cycle.

The routine of adjusting the tool size will include some programmed machine motions. As one example, adjustment nut 118 of tool holder 20 can automatically be brought into engagement with a set of parallel planes 146 and then the spindle rotated by a proper amount for effecting a change in the overall length of feed rod assembly 100, as evidenced by the different lengths of FIGS. 4 and 5. The control system will need to have a value representative of the wedge angle of the tool and ratio of the internal gearing to accurately calculate the proper rotation angle.

As a side note to this, the tool holder with a tool installed may be large enough that it may not be able to be kept in the machine's magazine. It may need to reside in a nest on the table that is away from the work piece but reachable by the spindle. Such a nest could be designed to include parallel planes 146 or similar apparatus to engage adjustment nut 118 on the tool holder, so that any tool size compensation could be made by a programmed spindle rotation just after it has grasped the tool holder but before it has removed it from its nest.

Advantages

Although they would not be necessary in all applications, the embodiment of tool holder 20 shown includes a pair of check valves that allows for lower feed forces to be obtained without the need to install an additional pressure regulator on the machine tool. In absence of these check valves, the coolant would be supplied to the top side of the piston for feeding and to the bottom side for retracting. However the area of the top side of the piston might be too great to achieve low levels of feed force even at the minimum pressure supplied by the machine. To achieve lower feed force coolant can be supplied to both sides of the piston as in the present embodiment. This creates a feed force F that is equal to the pressure times the difference between the axially facing top piston area and the bottom piston area, as explained above.

As also explained above, when the spindle is not rotating and the coolant is turned on, the pressurized coolant is routed to the bottom of the piston which keeps the feed rod in the retracted position (up). When the spindle rotates at sufficient velocity, then centrifugal force acting on the off-center release valve element will automatically switch the coolant path. The two check valves will change their positions under influence of the coolant pressure and coolant will be supplied to both sides of the piston. This will initiate the feed motion.

After final size is reached, as transmitted by LED 128, the machine tool control system will stop the spindle rotation. Biasing spring 70 will then change the coolant path back to the original state and the piston will retract the feed rod assembly, and the wedge element and honing elements of the attached honing tool. The tool can then be withdrawn from the work piece.

An additional feature is that there are no mechanical seals between the piston and its cylinder. This minimizes any friction between the two. Feed forces can be low and the piston will generally move very slowly during honing. Any friction/stick-slip in the system will detract from the constancy of the feed force. Also the centrifugal valve will actuate at lower spindle velocity if it is free to move without friction. Therefore the cylinder and piston will be made with very minimal clearance to minimize leakage past the piston and the valve will also be made with minimal clearance. Since this tool holder will operate in an environment where coolant is sprayed/splashed in all directions, some leakage of the fluid paths inside the tool holder should be of no consequence. The tool holder has sufficient openings to allow the escape of coolant that has leaked out of the pressurized path.

Honing Process Control

To use this device effectively the machine tool must have some control of coolant pressure. Ideally this would be via existing controls and hardware already in the machine tool. In the absence of that it could be possible to retrofit a pressure regulating device to the coolant delivery system that is either adjusted manually or preferably by a machine output signal.

The invention offers the following benefits over the prior art: A constant feed force will be maintained over the full travel of the honing tool and over the life of the abrasive stones.

The tool holder has an integral system for sensing a final feed position and sending a signal immediately when that position is reached. The feed position is equivalent to the wedge position in the honing tool and therefore implies a consistent final bore size. When used with honing elements such as abrasive stones that have minimal or consistent stone wear, this will produce close bore size control.

The tool holder's connection to the honing tool is identical to honing machine spindles so that any tools may be used interchangeably in a honing machine or any other machine tool equipped with this tool holder.

In light of all the foregoing, it should thus be apparent to those skilled in the art that there has been shown and described a novel HONING TOOL HOLDER WITH A FEED SYSTEM POWERED BY THROUGH-THE-SPINDLE COOLANT PRESSURE AND ACTUATED BY SPINDLE ROTATION. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A honing tool holder, comprising a body having a mounting element for cooperatively mounting the tool holder on a spindle of a machine tool for rotation therewith about a rotational axis therethrough and for receiving a flow of pressurized fluid from the spindle, and a tool holding element opposite the mounting element configured and operable for cooperatively holding a honing tool for rotation about the rotational axis; and a feed system carried on the body, configured to connect to a feed element of the honing tool held by the tool holding element, the feed system including a biasing element configured and operable to receive the pressurized fluid from the spindle and, in a first state to use the pressurized fluid to hold the feed element in a retracted position, then upon occurrence of a predetermined condition, to use the fluid to automatically direct a feed force against the feed element to urge honing elements of the tool radially outwardly relative to the tool, and apparatus configured and operable to automatically prevent radial movement of the feed element of the honing tool past a limit, the feed system including a release mechanism having a release element disposed within a radial passage within the body and biased by a spring toward a first position eccentrically adjacent to an axial center of the body, and movable in opposition to the spring by a centrifugal force generated by the rotation of the tool holder about the axial center, to a second position radially outwardly of the first position to connect the biasing element to a port for receiving the pressurized fluid.

2. The honing tool holder of claim 1, further comprising a signal device automatically operable to output a signal when the feed element is at the limit.

3. The honing tool holder of claim 1, wherein the feed system further comprises an element configured and operable for adjusting the limit.

4. The honing tool holder of claim 3, wherein the element configured and operable for adjusting the limit comprises an external element on the body movable relative thereto.

5. The honing tool holder of claim 4, wherein the external element is configured to be moved by movement of the tool holder relative to, and in contact with, a fixed object.

6. The honing tool holder of claim 5, wherein the movement of the tool holder relative to the fixed object comprises rotation of the tool holder.

7. A honing tool holder, comprising a body having a mounting element for cooperatively mounting the tool holder on a spindle of a machine tool for rotation therewith about a rotational axis therethrough and for receiving a flow of a pressurized fluid from the spindle, and a tool holding element opposite the mounting element configured and operable for cooperatively holding a honing tool for rotation about the rotational axis; and a feed system carried on the body, configured to connect to a feed element of the honing tool held by the tool holding element, the feed system including a piston assembly configured and operable for receiving the pressurized fluid and responsive to a predetermined condition indicative of the honing tool being located in a bore of a work piece, to exert a feed force against the feed element to urge honing elements of the tool radially outwardly relative to the tool, and apparatus configured and operable to automatically prevent operation of the piston assembly past a limit, the predetermined condition comprising rotation of the tool holder and the feed system comprising a release mechanism including a release element disposed within a radial passage within the body and biased toward a first position eccentrically adjacent to an axial center of the body, and movable in opposition to the biasing element by a centrifugal force generated by the rotation of the tool holder, to a second position radially outwardly of the first position to connect a cylinder containing the piston assembly with a port for receiving the pressurized fluid.

8. The honing tool holder of claim 7, wherein the feed system further comprises a release mechanism configured and operable to automatically engage an element of the feed system to prevent the operation of the piston assembly until the predetermined condition is present.

9. The honing tool holder of claim 7, further comprising an element configured and operable for adjusting the limit.

10. The honing tool holder of claim 9, wherein the element configured and operable for adjusting the limit comprises an external element on the body movable relative thereto.

11. The honing tool holder of claim 7, further comprising a signal device automatically operable to output a signal when the feed element is at the limit.

* * * * *